United States Patent [19]

Grundstrom et al.

[11] 4,073,165

[45] Feb. 14, 1978

[54] LOCKING DEVICE FOR KEYHOLES

[76] Inventors: Robert Ronnie Grundstrom, 452 Ave. V, Brooklyn, N.Y. 11223; Arthur Baylis, 156 West End Ave., Brooklyn, N.Y. 11235

[21] Appl. No.: 712,203

[22] Filed: Aug. 6, 1976

[51] Int. Cl.[2] ..... E05B 11/00; E05B 17/14

[52] U.S. Cl. ..... 70/371; 70/389; 70/424; 70/455

[58] Field of Search ..... 70/6, 371, 404, 423, 70/424, 425, 426, 427, 428, 455, 389

[56] References Cited

U.S. PATENT DOCUMENTS

| | | | |
|---|---|---|---|
| 3,298,210 | 1/1967 | Nyborg | 70/91 |
| 3,711,894 | 1/1973 | Walters | 16/144 |
| 3,968,985 | 7/1976 | Nielsen | 292/340 |

FOREIGN PATENT DOCUMENTS

| | | | |
|---|---|---|---|
| 30,321 | 1/1920 | Norway | 70/428 |

*Primary Examiner*—Robert L. Wolfe
*Attorney, Agent, or Firm*—A. J. Castorina

[57] ABSTRACT

A locking device comprised of a base plate secured about a keyhole and a cover plate pivotally disclosed thereon including locking means which can be disposed in aligned openings in the plates to selectively lock one to the other to either expose or cover the keyhole.

16 Claims, 7 Drawing Figures

LOCKING DEVICE FOR KEYHOLES

BACKGROUND OF THE INVENTION

The prior art relating to auxiliary locking devices for door locks to insure unauthorized use of the same pertinent to the present invention is generally typified in U.S. Pat. Nos. 1,206,601, 1,917,973 and 2,883,849.

Each of these patents disclose a base plate secured about the keyhole to be protected with a hole provided therein aligned with the same and a cover plate pivotally or slidingly co-operating with the base plate to cover the keyhole and means locking the said plates to one another. The keyhole is thereby covered and cannot readily be tampered with.

SUMMARY OF THE INVENTION

The present invention relates to a lock security device generally of the type described above but differing therefrom in its simplicity of construction and especially in the means for locking the cover plate to the base plate.

To this end aligned openings are provided in the plates and the locking means is inserted therein and the locking fingers provided therein are moved outwardly into corresponding openings provided in the base plate under the control of a key for securely maintaining the same therein.

The locking means comprises a cylinder with the locking fingers normally disposed in the interior thereof and a key retained therein until the same is turned to move the fingers outwardly and release the key from the retaining means.

Therefore the cylinder and key can be carried by an authorized person as a unit with the key locked therein until the same is to be used and thus the key cannot be lost by separation.

Additionally, the security device provides a further safety feature in that when the locking cylinder is in place its outer surface is flush with the top of the cover plate and thereby does not present any exposed surfaces which can be engaged by a tool to permit the same to be pried away therefrom.

These and other objectives and advantages of the invention will become more apparent from the following description and drawings.

DETAILED DESCRIPTION OF THE PREFERRED EMBODIMENT

Figure 1:
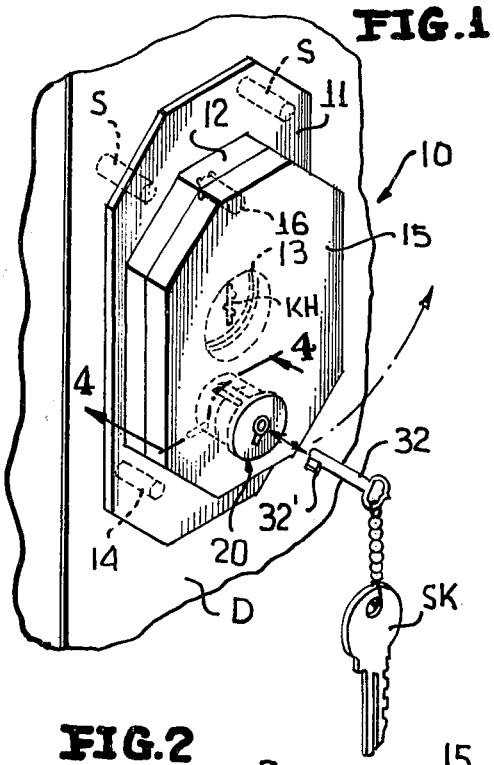
FIG. 1 is a view showing the security locking device positioned over the keyhole to be protected.

With reference to FIG. 1, the security device of the invention is designated generally by the reference numeral 10.

As seen the device is comprised of a base plate 11, which can be of any general configuration, having acentrally disposed raised planar area 12 having an opening 13 of the same general configuration as the keyhole KH disposed in the door D in order that access can be had thereto. The keyhole KH controls the security lock SL from the outside of the door D. The plate 11 is secured to the door D by fasteners S placed in openings 14 disposed about the edge of the plate.

Figure 3:
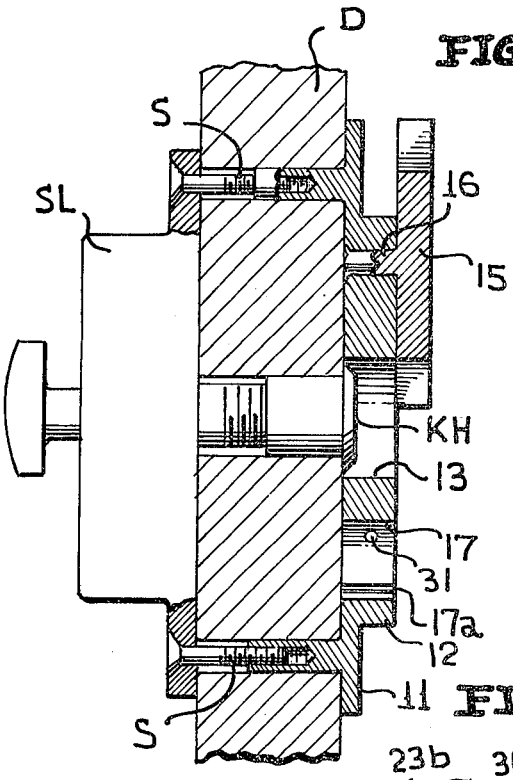
FIG. 3 is a sectional view showing the mounting details of the device taken on line 3—3 of FIG. 2.
Figure 2:
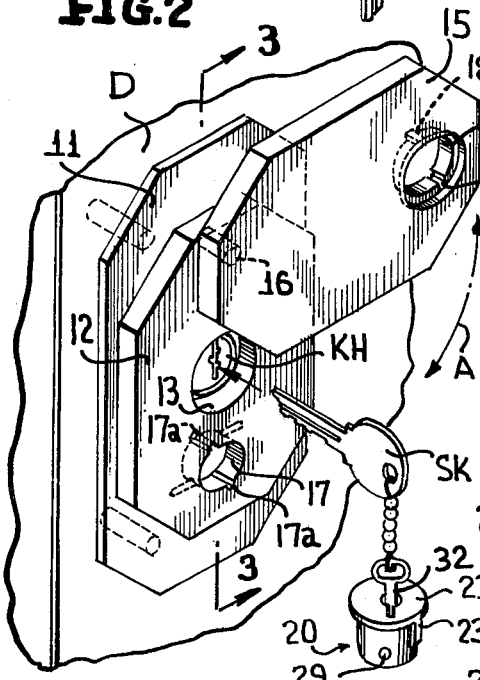
FIG. 2 is a view showing the cover plate pivoted to expose the keyhole.

A cover plate 15 is pivotally secured as at 16 to the base plate 11 which can be moved to a position to expose the keyhole as in FIGS. 2 and 3 to a position wherein the same is totally covered as shown in FIG. 1.

Both the base plate 11, 12 and cover plate 13 are provided with openings 17, 18 having diametrically opposed slots **17*a*, 17*a* and 18*a*, 18*a* all of which are in alignment when the plate is in its covering position. The opening 18 is countersunk at 19 for reasons to become apparent hereinafter. A locking means designated generally as 20 is inserted into the openings 17, 17 to secure the plates 11, 15** to one another to thereby prevent unauthorized access to the keyhole KH.

Figure 7:
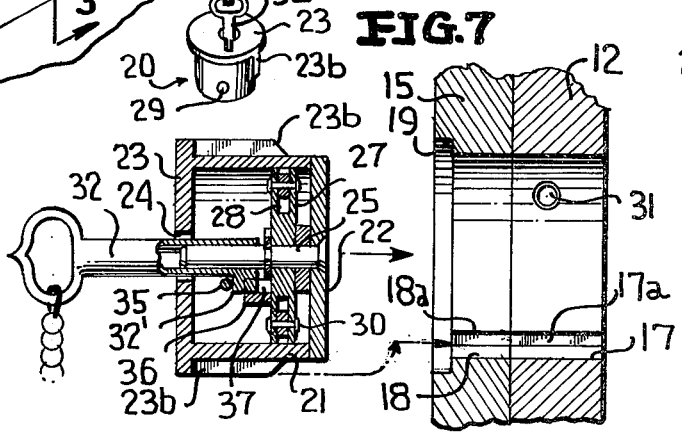
FIG. 7 shows an exploded view of the locking cylinder and its key actuator with respect to the plate receiving openings.

As seen in FIG. 7, the locking means 20 is comprised of a substantially closed cylinder 21 having a base 22 and a circular top 23 with the top defining an opening 24 providing access to the interior of the cylinder 21. The top 23 is of greater diameter than the cylinder body 21 having a flange **23*a* having opposed lugs 23*b*, 23*b* depending therefrom and extending along the periphery thereof. A locking mechanism 24 is disposed with the cylinder and is rotatably secured to the post 25 which is anchored to the base 22. The post 25 is centrally disposed in the cylinder and has its free end 26 terminate adjacent the opening 24**.

Figure 5:
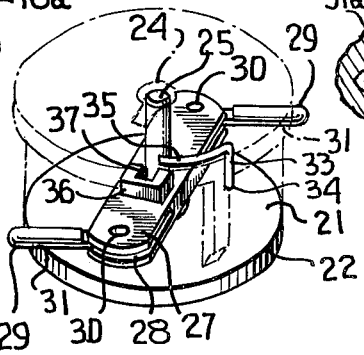
FIG. 5 shows the locking cylinder and the locking mechanism associated therewith.

With reference to FIG. 5, the locking mechanism 24 is seen to be comprised of an elongated plate 27 having a slotted recess 28 at each end thereof receiving a locking pin 29 fixedly disposed therein by a rivet 30 or the like at substantially a right angle to the plate 27. As seen the cylinder 21 has two openings 31, 31 disposed in its wall with one each being in alignment with the pins 29.

A tubular key 32 having a bit 32' controls the locking mechanism 24 and is normally retained with the cylinder 21 by the provision of an angled wire 33 having one end 34 secured to the base 22 and its free end 35 positioned over an abutment 36 fixedly connected to the top of the elongated plate 27. A slot 37 is provided in the abutment 36 and receives the bit 32' and as is apparent when the pins 29, 29 are in their retracted position the key bit 32' is positioned beneath the free end 35 of the wire and therefore cannot be removed.

Figure 4:
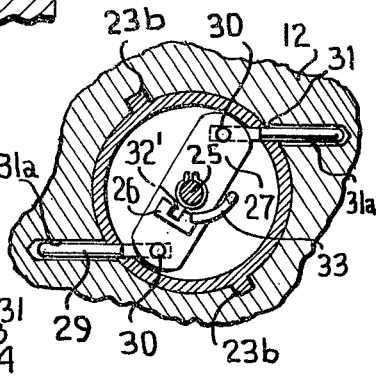
FIGS. 4 and 6 show the details of the locking mechanism of the device in its locked and unlocked position, respectively.
Figure 6:
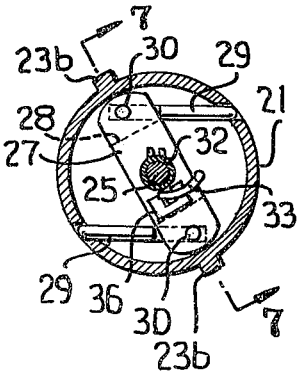

FIGS. 6 and 4, respectively, depict the operation of the locking pins 29 and as seen in FIG. 6, the pins are retracted therein due to the fact that the bit 32' of the key 32 is disposed under the wire 33 when the user turns the key 32, the bit 32' clears the wire 33 and causes the elongated plate 27 to turn due to the bit 32' being held captive in the slot 37 of the protuberence 36, and thereby cause the pins 29, 29 to move outwardly through the openings 31, 31 into aligned openings **31*a*, 31*a* provided in the plate 12. The cylinder 21 is therefore locked in place securing the cover plate 15 to the base plate 11, 12 and the key 32 is readily removable as the same has cleared the retaining wire 33**. The keyhole KH is now totally covered and cannot be readily tampered with.

In use and as seen in FIG. 2, the person availing himself of the device of the present invention locks the security lock SL by the security key SK in known fashion by inserting the same through the base plate opening 13. After locking, the cover plate is moved downwardly as shown by the arrow A until the openings 17 and 18 are aligned and the locking means 20 is placed therein by inserting the lugs 23*b*, 23*b* into the slots 17*a*, 18*a* to thereby prevent rotation thereof. At this point, the captive key 32 is turned causing the locking pins 29, 29 to move outwardly as explained hereinabove into the co-operating openings 31*a*, 31*a* thereby locking the cylinder in place. The key is then removed and the lock SL is protected from entry. To gain access to the lock SL the above steps are reversed.

While the fastening means S are shown as engaging and holding the base plate from the inside of the door in order to prevent the same from being tampered with from the outside thereof, it is considered apparent to reverse the same and have the fastening means hold the plate 11 in place from the front of the door.

What is claimed is:

1. A security locking device for a keyhole and the like comprised of a base plate, means adapted to secure the plate about the keyhole, an opening in the plate adapted to be aligned with the keyhole, a cover plate, means mounting the cover plate to the base plate to selectively cover and uncover the opening, means locking the cover plate to the base plate, said locking means including aligned openings disposed in each of said plates, a locking cylinder disposed in said opening, at least one locking pin disposed in said cylinder, means mounting said one pin for movement into and out of the cylinder and actuating means controlling said mounting means for moving said pin.

2. The security device of claim 1 wherein the means mounting said pin comprises a lever supporting said pin, post means rotatably mounting said lever and said actuating means engaging said post means for rotating said post.

3. The security device of claim 2 wherein the actuating means comprises a hollow key engaging the post.

4. The security device of claim 2 wherein means are provided for normally retaining said actuating means in said cylinder until the same is rotated.

5. The security device of claim 4 wherein the retention means comprises an L-shaped member having one end anchored in the cylinder and the free end positioned over a portion of the actuating means.

6. The security device of claim 5 wherein the actuating means comprises a hollow key engaging the post and said portion thereof is a key bit.

7. The security device of claim 6 wherein the bit engages a slot provided in an abutment mounted on said lever for rotating the same.

8. The security device of claim 2 wherein two pins are mounted on said lever and said cylinder is provided with opening through which the same can be extended and retracted.

9. The security device of claim 8 wherein openings are provided in said base plate for receiving said pins when the same are extended.

10. The security device of claim 9 wherein the cylinder is provided with guide means and the aligned openings with recesses for receiving the guide means for aligning the cylinder in the plates.

11. The security device of claim 7 wherein the cylinder is provided with guide means and the aligned openings with recesses for receiving guide means for aligning the cylinder in the plates.

12. A security locking device for a keyhole and the like comprised of a base plate, means adapted to secure the plate about the keyhole, an opening in the plate adapted to be aligned with the keyhole, a cover plate, means mounting the cover plate to the base plate to selectively cover and uncover the opening, means locking the cover plate to the base plate, said locking means including aligned openings disposed in each of said plates, a locking cylinder disposed in said opening, said locking cylinder including securing means mounted thereon, means mounting said securing means for movement into and out of the cylinder and actuating means controling said mounting means for moving said securing means.

13. A cylinder adapted to be disposed in an opening for locking the same therein including a housing, at least one pin disposed therein, means mounting said pin for movement into and out of said housing, said means including a post rotatably disposed in said housing and supporting said pin, actuating means engaging said post for rotating the same, means retaining said actuating means in said cylinder until the same is rotated, and wherein said retention means comprises an L-shaped member having one end anchored in the cylinder and the free end positioned over a portion of the actuating means.

14. The cylinder of claim 13 wherein the actuating means comprises a hollow key engaging the post.

15. The cylinder of claim 13 wherein the key is provided with a key bit.

16. The cylinder of claim 15 wherein the bit engages a slot provided in an abutment mounted on said lever for rotating the same.

* * * * *